United States Patent [19]

Thomi et al.

[11] 4,194,353

[45] Mar. 25, 1980

[54] ANALOG DISPLAY CALENDAR WATCH

[75] Inventors: Michel Thomi; Michel Groothuis; Serge Meylan, all of St.-Imier, Switzerland

[73] Assignee: Compagnie des Montres Longines Francillon SA, St.-Imier, Switzerland

[21] Appl. No.: 907,701

[22] Filed: May 19, 1978

[30] Foreign Application Priority Data

May 27, 1977 [CH] Switzerland ..... 6538/77

[51] Int. Cl.[2] ..... G04B 19/24; G04B 27/00

[52] U.S. Cl. ..... 368/38; 368/199; 368/228

[58] Field of Search ..... 58/4 R, 4 A, 5, 58, 58/125 R, 126 R, 85.5

[56] References Cited

U.S. PATENT DOCUMENTS

| | | | |
|---|---|---|---|
| 3,177,647 | 4/1965 | Meter | 58/58 |
| 3,449,905 | 6/1969 | Besson | 58/58 |
| 3,710,657 | 1/1973 | Cleusix | 58/58 |
| 3,751,901 | 8/1973 | Meitinger et al. | 58/58 |
| 3,882,669 | 5/1975 | Jakob | 58/58 |

FOREIGN PATENT DOCUMENTS

| | | | |
|---|---|---|---|
| 444055 | 2/1968 | Switzerland | 58/58 |

*Primary Examiner*—Vit W. Miska

*Attorney, Agent, or Firm*—Wender, Murase & White

[57] ABSTRACT

Analog display calendar watch having a window or windows and an hour spindle changing device in which the movements of the hour hand and the disc or discs of the calendar are synchronized.

The calendar disc is driven once every 24 hours by a rocker lever which supports a plate having a catch engaging the calendar disc, the plate being rotated by a 24-hour wheel and effecting a whole number, greater than one, of turns in 24 hours. The width of the catch is slightly less than the space between two teeth of the calendar disc, so that any forward or backward movement of the hour hand, controlled by the hour setting spindle, permits an immediate forward or backward movement of the calendar disc.

5 Claims, 6 Drawing Figures

ANALOG DISPLAY CALENDAR WATCH

BACKGROUND OF THE INVENTION

The object of the present invention is to provide an analog display calendar watch having a window or windows and an hour spindle changing device in which the movements of the hour hand and the disc or discs of the calendar are synchronised.

SUMMARY OF THE INVENTION

According to the present invention there is provided an analog display calendar watch having at least one window and an hour hand capable of being displaced by 1/12 of a turn, in which the movement of the hour hand at midnight automatically and simultaneously drives the calendar disc or discs in a direction corresponding to that of the hand, whatever the mode of advance or the direction of rotation of the hour hand.

A preferred embodiment of the invention comprises a rocker lever controlled by a pin connected to a 24 hour wheel, the said rocker carrying a pinion engaging in the 24 hour wheel, the said pinion effecting a whole number, greater than one, of turns within 24 hours and being connected to a plate having a catch for engaging with at least one calendar disc. Once every 24 hours the pin allows the rocker lever to pivot to permit the catch to act on one of the teeth of the calendar disc in order to drive it rapidly until a jumper causes the calendar disc to jump to the next space. The catch and the teeth of the calendar disc are shaped so that, immediately after the jump of the disc, any backward movement of the hour hand, controlled by the spindle for setting the hour, immediately causes the turning back of the calendar disc.

DESCRIPTION OF THE PREFERRED EMBODIMENT

Figure 1:
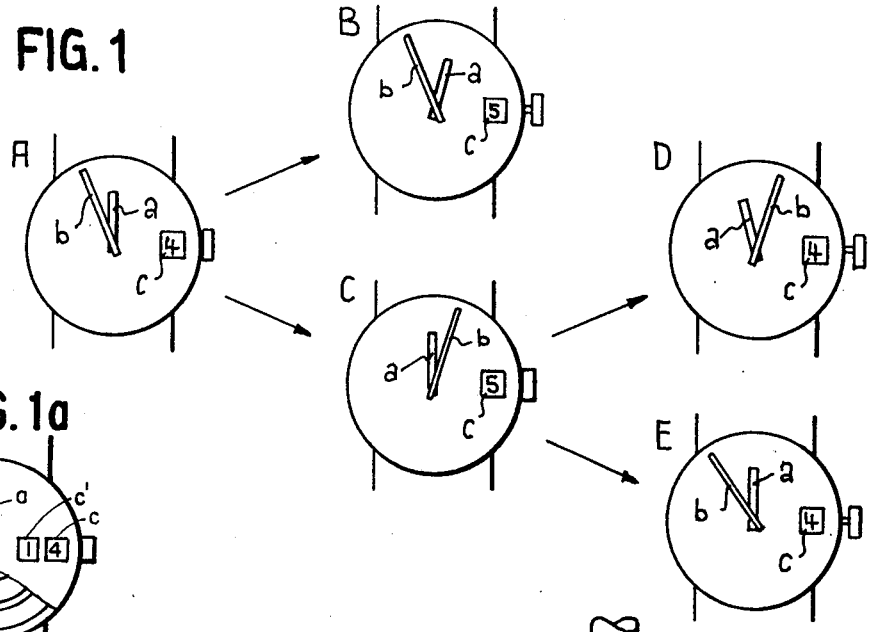
FIG. 1 is a diagrammatic plan view of an analog display calendar watch incorporating a preferred embodiment of the invention, illustrating transitions during the operation thereof.

In FIG. 1, it is assumed that the watch is fitted with an hour changing device. The operations performed in the transitions shown in FIG. 1 are set out below:

A to B indicates an alteration of the hour spindle; the hour hand "a" turns, the date "c" jumps positively;

A to C indicates normal operation or time setting; the hands "a" and "b" turn, the date "c" jumps positively;

C to D indicates an hour change; the hour hand "a" turns backwardly, the date "c" jumps negatively;

C to E indicates a time setting; the hands "a" and "b" turn backwardly, the date 37 c" jumps negatively.

Figure 2:
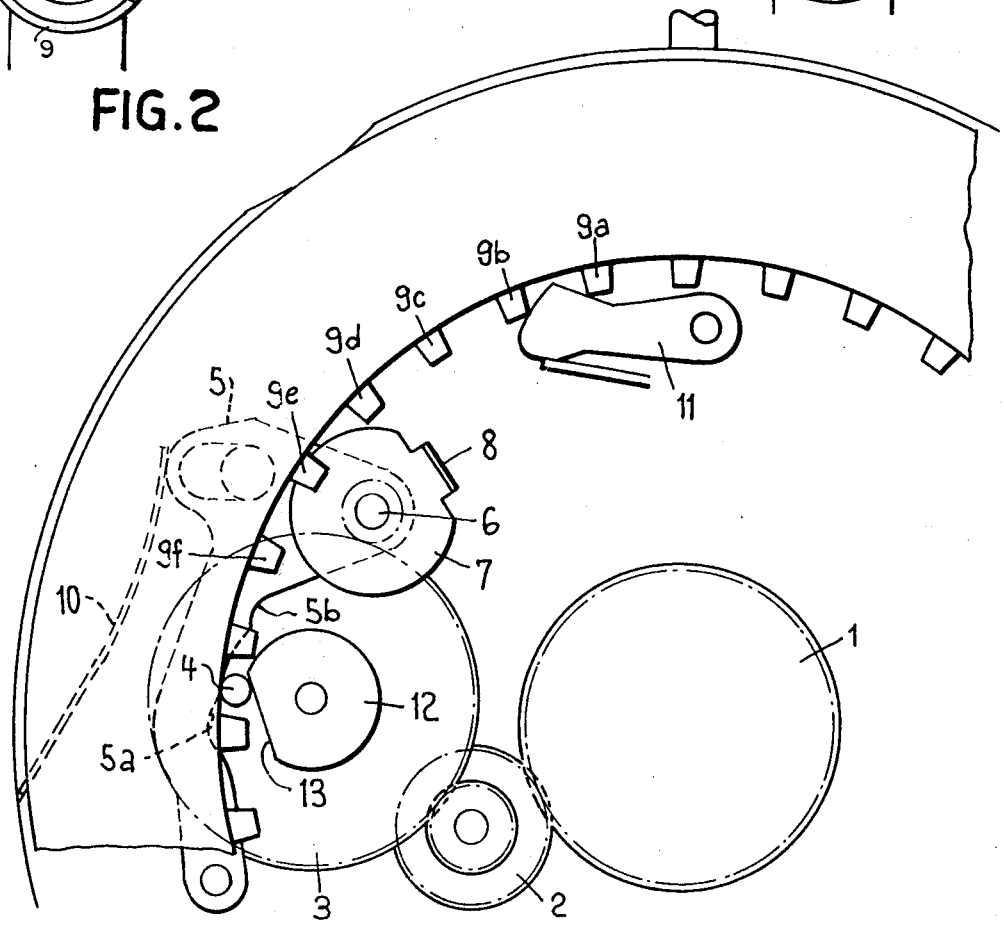
FIG. 2 is a diagrammatic plan view of a preferred embodiment of an analog display calendar watch mechanism according to the invention.

FIG. 2 explains the operation of an embodiment of the mechanism according to the invention.

A wheel 1 connected to the hour hand drives a reduction gear 2 which drives a wheel 3, called the 24-hour wheel, which performs one rotation in 24 hours. This wheel 3 has a pin 4 which controls a rocker lever 5 by its cam surfaces 5*a* and 5*b*. Pivotally mounted on this rocker lever 5 is a pinion 6 which engages with the 24-hour wheel 3. The ratio between the wheel 3 and the pinion 6 is such that the pinion 6 effects a whole number (greater than one) of rotations in 24 hours. Fixed to this pinion 6 is a plate 7 with a bent catch 8. This catch 8 can come into contact with teeth 9*d*, 9*e*, 9*f* of a calendar disc 9. Since the pinion 6 effects several turns in 24 hours, it is necessary that it should not be able to continuously drive the teeth of the calendar disc, therefore it is mounted on the rocker 5 which, under the action of the spring 10, normally holds it away from the teeth of the disc 9. However, when the pin 4 engages the ramp 5*a*, the catch 8 is able to drive the tooth 9*e*.

Secured to the 24-hour wheel 3 is a circular cam 12 with a flat 13. The circumference of this cam 12 is engaged between two of the teeth of the calendar disc 9, preventing it from turning prematurely, except when the disc 9 is controlled by the catch 8, during which time the said flat 13 allows the teeth of the calendar disc 9 to pass.

Figure 1A:
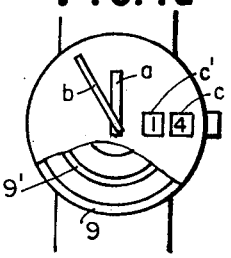
FIG. 1*a* is a diagrammatic plan view of an analog display calendar watch, partially cut away, incorporating an alternative embodiment having a two digit calendar date.
Figure 3A:
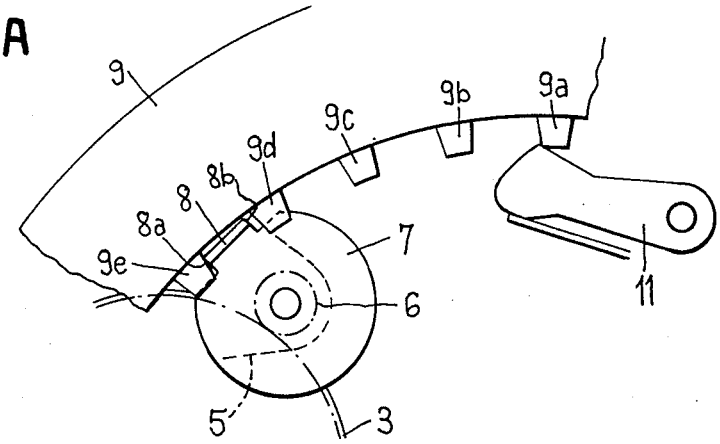
FIG. 3A is a diagrammatic plan view of one embodiment in accordance with the present invention illustrating the relative positions of the parts for actuating the calendar disc when the watch is in the position shown in FIG. 1A.
Figure 3B:
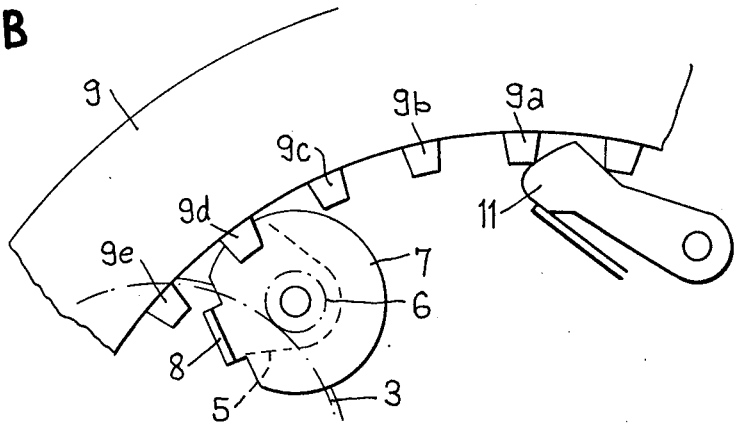
FIG. 3B is a diagrammatic plan view of one embodiment in accordance with the present invention illlustrating the relative positions of the parts actuating the calendar disc in the position shown in FIG. 1B.
Figure 3C:
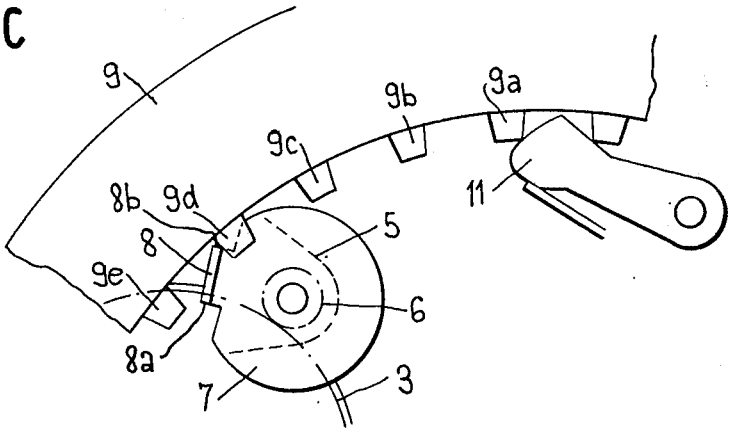
FIG. 3C is a diagrammatic plan view of one embodiment in accordance with the present invention illustrating the relative position of the parts actuating the calendar disc in the position shown in FIG. 1C.

FIGS. 3A, 3B and 3C respectively show the relative positions of the parts actuating the calendar disc 9 when the watch is in the positions shown in FIGS. 1A, 1B and 1C.

In FIG. 1A, the watch shows approximately 23 hours 54 minutes and the calendar displays 4. The catch 8 (FIG. 3A) bears by its front edge 8*a* against the tooth 9*e* of calendar disc 9, and it has begun to drive this disc, a jumper 11 is raised by the tooth 9*a*. It will be noted that the play between the rear edge 8*b* of the catch 8 and the tooth 9*d* is very small, so that any return movement of the hands (by time setting or a backward change of the hour spindle) immediately returns the disc 9 to its starting position in which the jumper 11 is situated between the teeth 9*a* and 9*b* of the disc 9 by the action of the face 8*b* of the catch 8 on the tooth 9*d*.

In FIG. 3B the position is the one corresponding to FIG. 1B. An hour spindle change in the forward direction has been effected since the position shown in FIG. 1A. The catch 8 has driven the disc 9 by its tooth 9*e*, so that the date has jumped and the window displays the digit 5 corresponding to the movement of the hour hand at midnight. The jumper 11 positions the calendar disc 9 by the back of the tooth 9*a*.

In FIG. 3C, the position is the one corresponding to FIG. 1C. The watch has continued to work normally, the front face 8*a* of the catch 8 has continued to drive the disc 9 by its tooth 9*e*, then the jumper 11 has advanced the disc 9 by pushing its tooth 9*a*. It will be seen that, in this position, the tooth 9*d* has become disposed against the rear face 8*b* of the catch 8. The date has jumped and the window displays the digit 5.

If, in the position shown in FIG. 1C, a backward change of the hour spindle has been made, according to FIG. 1D, or a backward time setting, according to FIG. 1E, FIG. 3C clearly shows that the catch 8 immediately drives, by its rear face 8*b*, the tooth 9*d* of the disc 9 in a backward movement, so that the display of the calendar returns to the digit 4 when the hour hand passes over the digit 12 of the dial again.

What has been stated above shows that the device according to the invention in practise does not permit any dephasing between the indications of the hour hand and the number shown in the window. The hour hand and the calendar disc are therefore permanently synchronised. This is a basic and essential feature of a watch in which the hour hand alone can be actuated in order to make a time correction with changes of the hour spindles.

It is obvious that the mechanism described above may also be used in a mechanical watch as well as in an electronic watch and that it may include more than one calendar disc.

One such embodiment is illustrated in FIG. 1*a*, in which an additional calender disc 9' is provided for indicating data portion c' through another window.

Similarly, the wheel 1 may be a mechanism actuating the hour hand by a 1/12 of a turn in order to permit adaptation of the date during a change of the hour spindle.

What we claim is:

1. An analog digital display calendar watch, comprising:

an hour hand capable of being rotatably advanced or reversed by steps of 1/12 of a turn;

a wheel making one rotation every 24 hours as indicated by the watch, said 24-hour wheel having a pin;

a rocker lever mounted on the watch, said pin rocking said lever once every ≧hours;

a pinion rotatably carried on said rocker lever for engaging said 24-hour wheel;

a plate secured to said pinion having a catch;

a calendar disc having spaced teeth for engagement with said catch; and a jumper engaging said disc teeth for positioning said disc;

said rocking of said lever causing said catch to engage between two consecutive teeth of said calendar disc, so that said disc is automatically and rapidly driven in a direction corresponding to that of said hour hand, regardless of the mode of advance and direction of rotation of said hours hand.

2. A watch according to claim 1, wherein:

said pinion rotates a plural whole number of turns in 24 hours, resulting in rapid engagement of a leading edge of said catch with one of the teeth of said calendar disc, thus driving said calendar disc rapidly until said jumper causes said disc to jump to the following tooth;

said catch having its width only slightly less than the space between two consecutive teeth of said calendar disc, so that any backward movement of said hours hand permits a rear edge of said catch to act on the preceding tooth, further causing immediate return of said calendar disc, said hours hand and said calendar disc being thus permanently synchronized.

3. A watch according to claim 1, including more than one calendar disc and more than one window for the display of information contained on said discs.

4. A watch according to claim 1, including a mechanism permitting actuation, in both directions of rotation, of the hour hand alone.

5. A watch according to claim 4, in which said mechanism actuates said hour hand by a 1/12 of a turn.

* * * * *

UNITED STATES PATENT AND TRADEMARK OFFICE

CERTIFICATE OF CORRECTION

PATENT NO. : 4,194,353

DATED : March 25, 1980

INVENTOR(S) : Michel Thomi et al

It is certified that error appears in the above-identified patent and that said Letters Patent are hereby corrected as shown below:

Column 4, line 2, "≥" should read -- 24 --.

Signed and Sealed this

*Twenty-ninth* Day of *July 1980*

[SEAL]

*Attest:*

SIDNEY A. DIAMOND

*Attesting Officer*

*Commissioner of Patents and Trademarks*